US009180707B2

(12) United States Patent
Onishi

(10) Patent No.: US 9,180,707 B2
(45) Date of Patent: Nov. 10, 2015

(54) RECORDING APPARATUS

(71) Applicant: SEIKO EPSON CORPORATION, Tokyo (JP)

(72) Inventor: Ryoichi Onishi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/220,563

(22) Filed: Mar. 20, 2014

(65) Prior Publication Data

US 2014/0292975 A1 Oct. 2, 2014

(30) Foreign Application Priority Data

Mar. 27, 2013 (JP) ..... 2013-065767

(51) Int. Cl.
*B41J 23/00* (2006.01)
*B41J 29/02* (2006.01)
*B41J 3/28* (2006.01)

(52) U.S. Cl.
CPC . *B41J 29/023* (2013.01); *B41J 3/28* (2013.01)

(58) Field of Classification Search
CPC ..... B41J 23/00
USPC ..... 347/104
See application file for complete search history.

(56) References Cited

U.S. PATENT DOCUMENTS 5,650,820 A * 7/1997 Sekine et al. ..... 347/263
2012/0069089 A1* 3/2012 Hendricks et al. ..... 347/37

FOREIGN PATENT DOCUMENTS

JP 2002-002054 1/2002
JP 2012-055990 3/2012
JP 2012-210781 11/2012

* cited by examiner

*Primary Examiner* — Manish S Shah
*Assistant Examiner* — Roger W Pisha, II
(74) *Attorney, Agent, or Firm* — Workman Nydegger

(57) ABSTRACT

A recording apparatus includes a supporting stage that supports a recording medium; a recording processing unit, which includes a recording unit that opposes the recording medium that is supported by the supporting stage, and bridges an X axis direction so as to cross the supporting stage; and a Y axis movement unit causes the recording processing unit to move in relation to the supporting stage in a Y axis direction that is perpendicular to the X axis direction and is parallel to a supporting surface of the supporting stage, in which the Y axis movement unit includes a drive mechanism, which causes the recording processing unit to move in the Y axis direction in relation to the supporting stage, and a linear guide mechanism, which is disposed on a rear surface side of the supporting stage, and supports the recording processing unit to be free sliding in the Y axis direction in relation to the supporting stage.

8 Claims, 7 Drawing Sheets

RECORDING APPARATUS

BACKGROUND

1. Technical Field

The present invention relates to a so-called flatbed type recording apparatus, in which a recording unit moves, and performs recording on a recording medium that is positioned on a stage.

2. Related Art

In the related art, a known example of this type of recording apparatus includes a base member, and a flatbed which is disposed on the base member and supports a recording paper (refer to JP-A-2002-2054). This known example further includes an ink head that is disposed to face the flatbed, a carriage on which the ink head is mounted, and a supporting member which supports the carriage to be freely movable in a horizontal direction (i.e., a Y axis direction). The known example further includes a pair of left and right rails which extend in a horizontal X axis direction (perpendicular to the horizontal Y axis direction in the perpendicular plane) on a base member. The known example also includes a pair of left and right movable blocks which are fixed to the supporting member and are capable of moving on the rails. In other words, in this recording apparatus, a linear guide mechanism (such as a pair of rails and a pair of movable blocks) is disposed on the upper surface side of the base member in a manner in which the linear guide mechanism supports the carriage to be freely movable in the X axis direction via the supporting member.

However, in this configuration, since the linear guide mechanism is disposed on the upper surface side of the base member (i.e., on the surface side of the flatbed), the positions of the supporting member and the carriage become higher by an amount of the dimensions of the linear guide mechanism. As a result, there is a problem in that the height dimension (i.e., the dimension in which the ink head and the flatbed face one another) of the entire recording apparatus becomes larger. Furthermore, since the linear guide mechanism is disposed to avoid the placement region in which the recording paper is placed, there is a problem in that a planar dimension (a horizontal dimension perpendicular to the height direction) of the entire recording apparatus become larger by the amount of the dimensions of the linear guide mechanism.

It is also conceivable to dispose the linear guide mechanism on the surfaces on the left and right lateral sides of the base member; however, even in this case, the planar dimensions of the entire recording apparatus become larger by the amount of the dimensions of the linear guide mechanism.

SUMMARY

An advantage of some aspects of the invention is that a recording apparatus is provided, in which it is possible to reduce the dimensions of the entire recording apparatus.

According to an aspect of the invention, there is provided a recording apparatus that includes a stage, which includes a supporting surface that supports a recording medium; a recording processing unit, which includes a recording unit that performs recording on the recording medium that is supported by the stage, and bridges a first direction so as to cross the stage; and a movement unit, which causes the recording processing unit to move in relation to the stage in a second direction that is perpendicular to the first direction and is parallel to the supporting surface, in which the movement unit includes a drive mechanism, which causes the recording processing unit to move in the second direction in relation to the stage, and a linear guide mechanism, which is disposed on a rear surface side of the stage, and supports the recording processing unit to be free sliding in the second direction in relation to the stage.

In this configuration, by disposing the linear guide mechanism on the rear surface side of the stage, the position of the recording processing unit is not heightened by the amount of the dimensions of the linear guide mechanism. In other words, it is possible to reduce the height dimension of the entire recording apparatus (the dimension of the direction in which the recording unit and the stage oppose one another). By causing the stage and the linear guide mechanism to overlap one another by disposing the linear guide mechanism on the rear surface side of the stage, it is possible to reduce the planar dimensions (the dimensions of the directions that are perpendicular to the opposing direction described above) of the entire recording apparatus in comparison with a configuration in which "the linear guide mechanism is disposed on the lateral side of the stage". Furthermore, the linear guide mechanism does not interfere with the recording performed by the recording unit due to the linear guide mechanism being disposed on the rear surface side of the stage. Accordingly, it is possible to dispose the linear guide mechanism to overlap with the recording unit and the recording medium; thus, it is possible to reduce the planar dimensions of the entire recording apparatus even in comparison to a configuration in which "the linear guide mechanism is disposed on the upper surface side of the stage". In addition, when the stage is configured by the table main body and the structural bar to which the table main body is attached, it is possible to guarantee the parallelism of the table attachment surfaces onto which the table main body is attached, and the parallelism of the attachment surfaces (the rail attachment surfaces) onto which the linear guide mechanism (for example, the guide rail) is attached by only milling the upper and lower surfaces thereof in relation to the structural bars. Accordingly, it is possible to manufacture the recording apparatus easily in comparison to a configuration in which "the linear guide mechanism is disposed on the lateral side of the stage", where it is necessary to mill the side surfaces.

In this case, it is preferable that the movement unit include a plurality of the linear guide mechanisms, which are separated from one another in the first direction.

In this configuration, by using a plurality of the linear guide mechanisms that are separated from one another in the first direction, it is possible to stably perform the movement in the second direction regardless of the position of the drive mechanism.

It is preferable that the drive mechanism be disposed between the plurality of linear guide mechanisms in the first direction.

In this configuration, by using a plurality of the linear guide mechanisms that are disposed to interpose the drive mechanism, it is possible to stably perform the movement in the second direction. For example, by including two of the linear guide mechanisms and disposing the drive mechanism in the middle, between the linear guide mechanisms, it is possible to dispose the drive mechanism and the linear guide mechanisms such that the distance therebetween is as short as possible, and good balance is obtained. Therefore, it is possible to suppress the influence of yawing centered on the drive mechanism.

In this case, it is preferable that the drive mechanism be disposed between a portion of the stage that makes contact with the recording medium, and the linear guide mechanism in a third direction, which is perpendicular to the first direction and the second direction.

In this configuration, it is possible to dispose the drive mechanism to be as close as possible to a portion of the stage that makes contact with the recording medium (the supporting surface). Therefore, it is possible to suppress the influence of pitching centered on the drive mechanism. The movement mechanism does not interfere with the recording performed by the recording unit due to the movement mechanism being disposed between the portion of the stage that makes contact with the recording medium and the linear guide mechanism. Accordingly, it is possible to dispose the drive mechanism to overlap the recording unit and the recording medium. For example, it is possible to dispose the drive mechanism on the middle of the stage.

In this case, it is preferable that the recording processing unit include a recording unit, a horizontal bridging frame, which crosses the stage and supports the recording unit, a pair of side frames, which holds the horizontal bridging frame by a first side and a second side in the first direction, and a connecting frame, which connects base portion sides of the pair of side frames to one another, and that the linear guide unit include a guide rail, which is fixed to a rear surface side of the stage, and extends in the second direction, and a slider, which is fixed on the connecting frame, and moves on the guide rail in a free sliding manner.

In this configuration, it is possible to accurately perform the movement of the recording unit relative to the stage due to the fixed side (the guide rail) of the linear guide mechanism being fixed to the stage, and the movable side (the slider) of the linear guide mechanism being fixed to the connecting frame. Accordingly, it is possible to improve the movement accuracy of the recording unit.

In this case, it is preferable that the drive mechanism be mounted on the connecting frame.

When the drive mechanism is mounted on the side frame that has low rigidity in the first direction, there is a concern that the linear movement carried out by the drive mechanism will be shifted in the first direction.

In contrast, in the configuration described above, by mounting the drive mechanism on the connecting frame, the linear movement carried out by the drive mechanism is not shifted in the first direction, and it is possible to more stably perform the movement of the recording unit in the second direction. The configuration described above does not impede the attachability or maintainability of the movement mechanism.

In this case, it is preferable that the drive mechanism be configured by a drive motor, and a lead screw mechanism, which is driven by the drive motor.

In this configuration, by using the lead screw mechanism (for example, the ball screw mechanism) for the drive mechanism, it is possible to reduce the costs of the drive mechanism.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
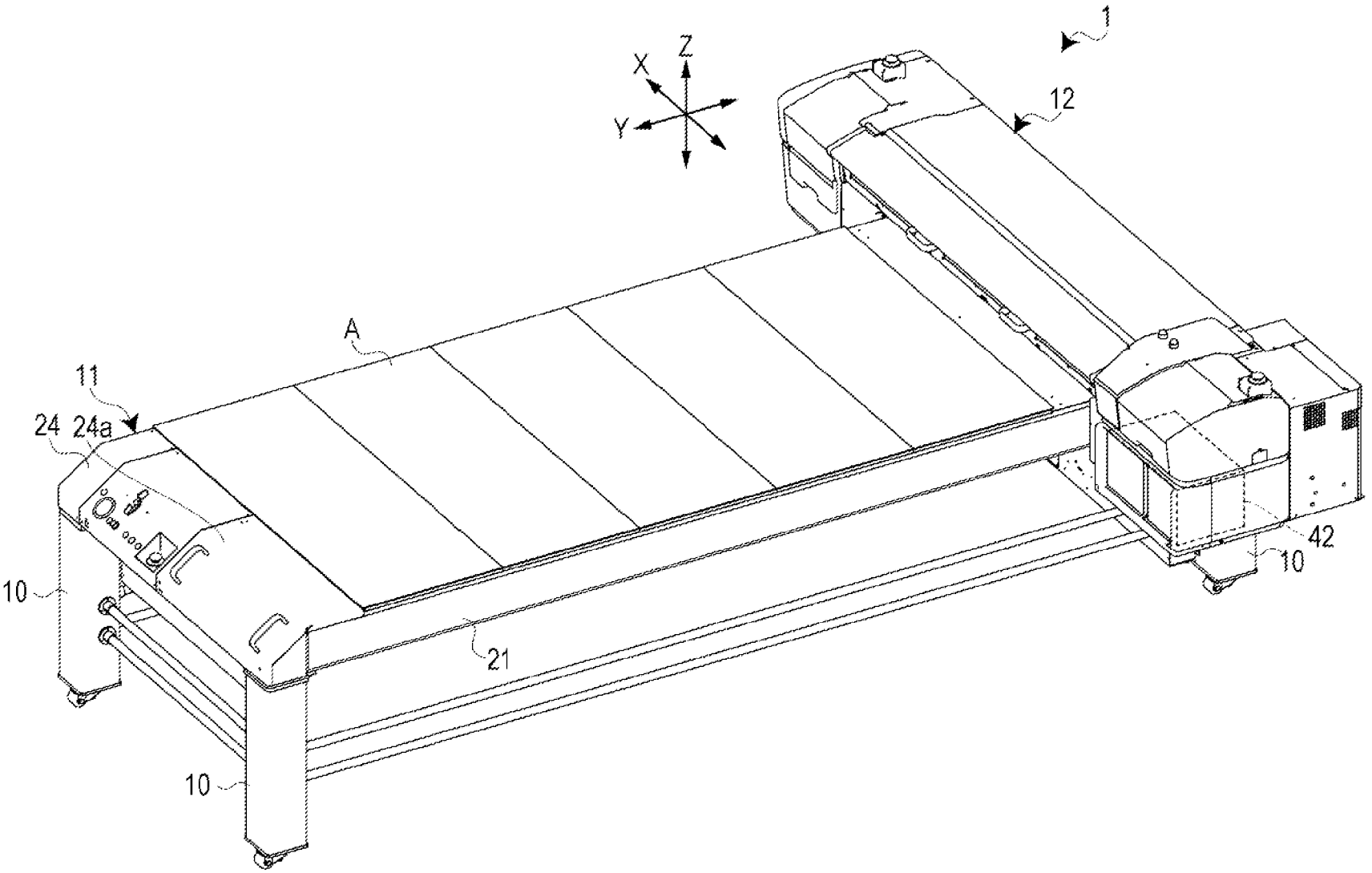
FIG. 1 is an external perspective view showing a recording apparatus according to an embodiment.

Hereinafter, the description of the recording apparatus according to an embodiment of the invention will be given with reference to the accompanying drawings. The recording apparatus records a desired image on a recording medium by discharging an ultraviolet curing ink using an ink jet system. Furthermore, the recording apparatus is a so-called flatbed type recording apparatus that performs recording by causing a recording head to move in relation to the recording medium, which recording medium is supported by a supporting stage. The recording medium could be, for example, recording media of any thickness such as thick paper, wood, tile, plastic board, and cardboard.

As will now be described, the X axis (left and right) direction, the Y axis (front and back) direction and the Z axis (up and down) direction are defined as shown in the drawings. The Y axis direction and the X axis direction are directions that are parallel to the supporting surface (the setting surface) of the supporting stage. The Y axis direction is perpendicular to the X axis direction, and the Z axis direction is perpendicular to the X axis direction and the Y axis direction. The far side in FIG. 1 will be referred to as a "first side in the Y axis direction", and the near side in FIG. 1 will be referred to as a "second side in the Y axis direction".

Figure 2A:
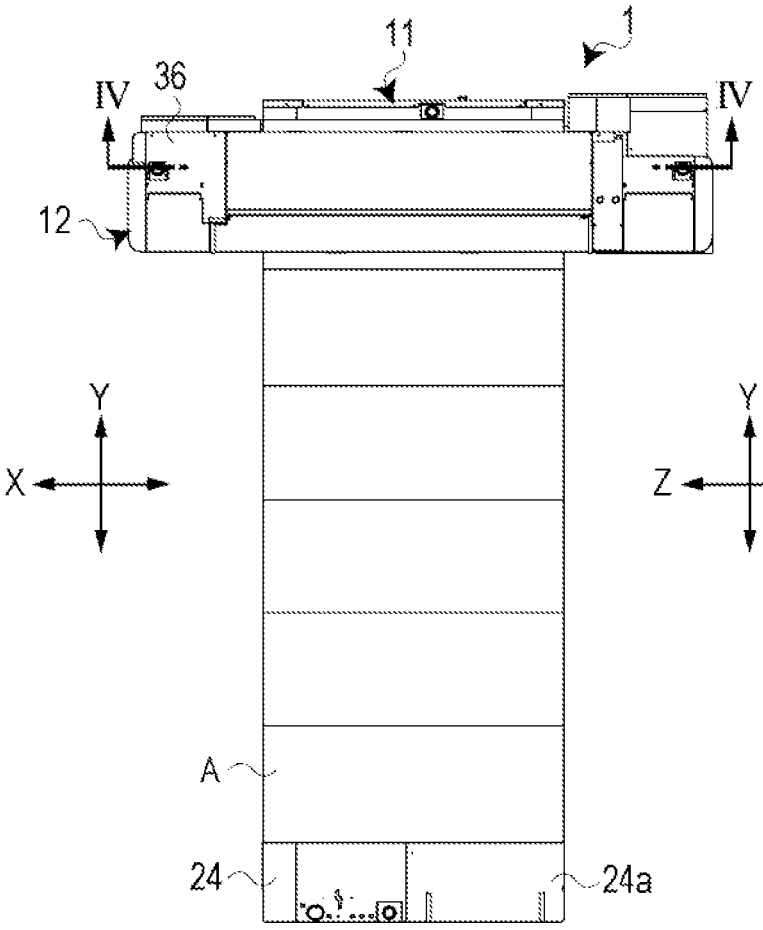
FIGS. 2A to 2C are respectively a plan view, a front view and a side view showing the recording apparatus.
Figure 2C:
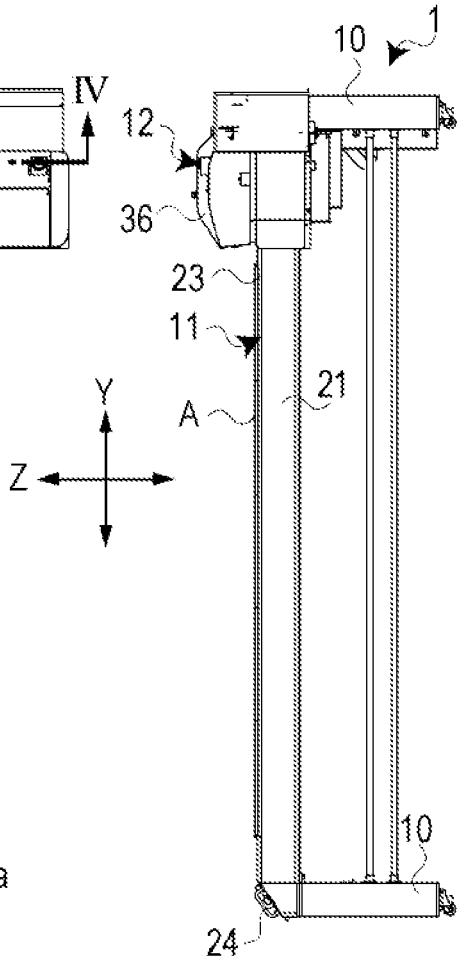
Figure 2B:
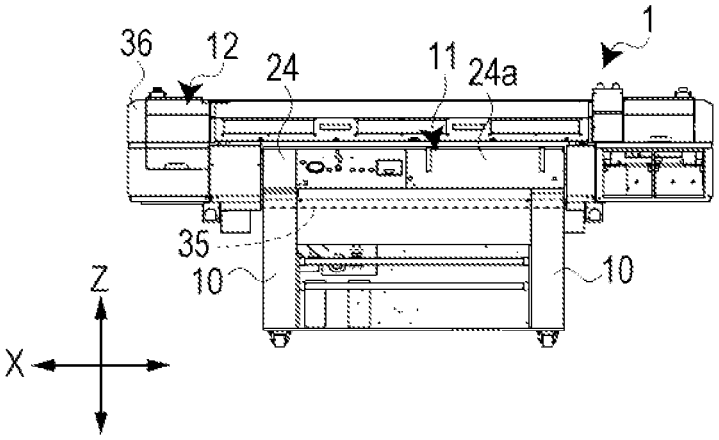
Figure 3:
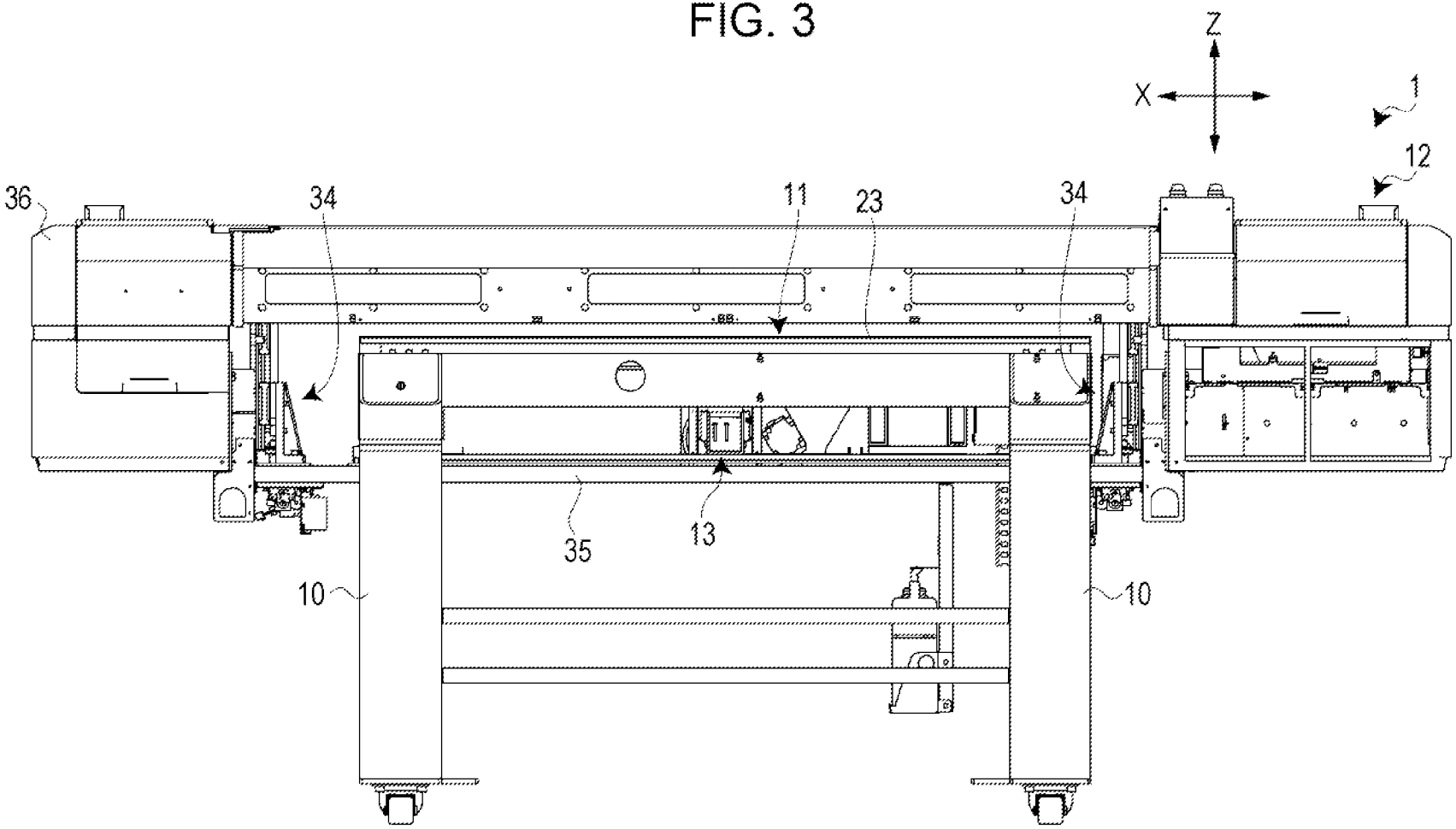
FIG. 3 is a front view showing the recording apparatus with a portion of a supporting stage and a portion of an apparatus cover omitted.

As shown in FIGS. 1 to 3, a recording apparatus 1 is supported by four leg members 10, and is provided with a supporting stage (a stage) 11 that supports a recording medium A, a recording processing unit 12 that includes a recording unit 31 (labeled in FIGS. 5 and 6) facing the supported recording medium A, and a Y axis movement unit (a movement unit) 13 that supports the recording processing unit 12 and causes the recording processing unit 12 to move in the Y axis direction (a second direction) in relation to the supporting stage 11. The recording processing unit 12 spans the X axis direction (a first direction) so as to cross over the supporting stage 11 in the first direction. Meanwhile, the Y axis movement unit 13 is disposed on the rear surface side of the supporting stage 11 (the surface of the opposite side from the recording processing unit 12 side) to overlap the supporting stage 11, and supports the recording processing unit 12 in a freely movable manner on the rear surface side of the supporting stage 11 (described hereinafter in detail).

Figure 4:
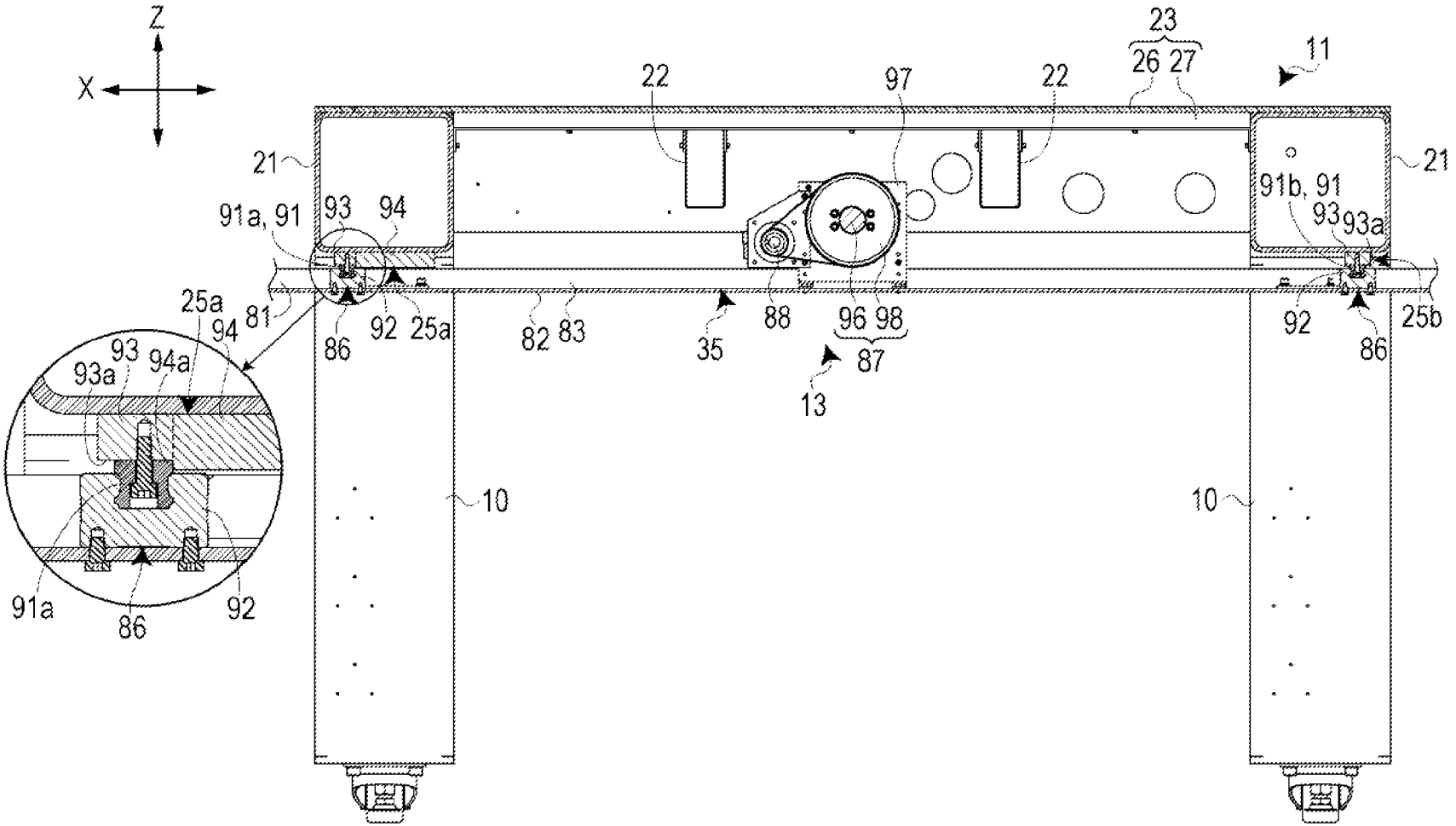
FIG. 4 is a cross-sectional view across the line IV-IV showing the supporting stage and the periphery of a Y axis movement unit.

Next, description will be given of the supporting stage 11 with reference to FIGS. 1, 2A to 2C and 4. FIG. 4 is a cross-sectional view across the line IV-IV (see FIG. 2A) of the supporting stage 11 and of the periphery of the Y axis movement unit 13 when viewed from the first side in the Y axis direction. As shown in FIGS. 1, 2A to 2C and 4, the supporting stage 11 includes a pair of left and right beam-shaped structural bars 21 that extend in the Y axis direction, a plurality of supporting members 22 that are disposed in a grid pattern lengthwise and breadthwise between the pair of structural bars 21, and a suction table 23 that is supported by the pair of structural bars 21 and the plurality of supporting members 22. The recording medium A is set in place on the structural bars 21 and the plurality of supporting members 22 by suction. Each of the end portions of the structural bars 21 are connected to the respective leg members 10 by welding or the like.

An operation panel unit 24 (see FIGS. 1 to 2C) is disposed on the end portions of the second side of the supporting stage 11 in the Y axis direction. An access door 24*a* is provided over a wide portion of the right half portion of the operation panel unit 24. When manually performing maintenance on the recording processing unit 12, the recording processing unit 12 is caused to move to the near side (the second side in the Y axis direction), the access door 24*a* is opened, and the maintenance of the recording processing unit 12 is performed from the access door 24*a*.

The suction table 23 includes a table main body 26 (labeled in FIG. 4) that includes a supporting surface which supports the recording medium A, and has a large number of suction pores (omitted from the drawings). The suction table 23 also includes a suction chamber 27 provided on the underside of the table main body 26. The suction chamber 27 is connected to a vacuum suction facility (not shown) by a pipe, a duct, or the like. In other words, by driving the vacuum suction facility, the recording medium A that is placed on the table main body 26 is suctioned, and the recording medium A is thereby held onto the table main body 26.

The structural bar 21 is configured from a bar, the cross-sectional shape of which is square (e.g., a square pipe), and both end portions in the Y axis direction thereof are connected to the respective leg members 10. The upper surface (the surface side) of the structural bar 21 is a table attachment surface, to which the table main body 26 is attached. Rail attachment bases 25*a* and 25*b* (labeled in FIG. 4) for attaching guide rails 91 (described hereinafter) are fixed to the respective lower surfaces (the rear surface side) of the structural bars 21.

Figure 5:
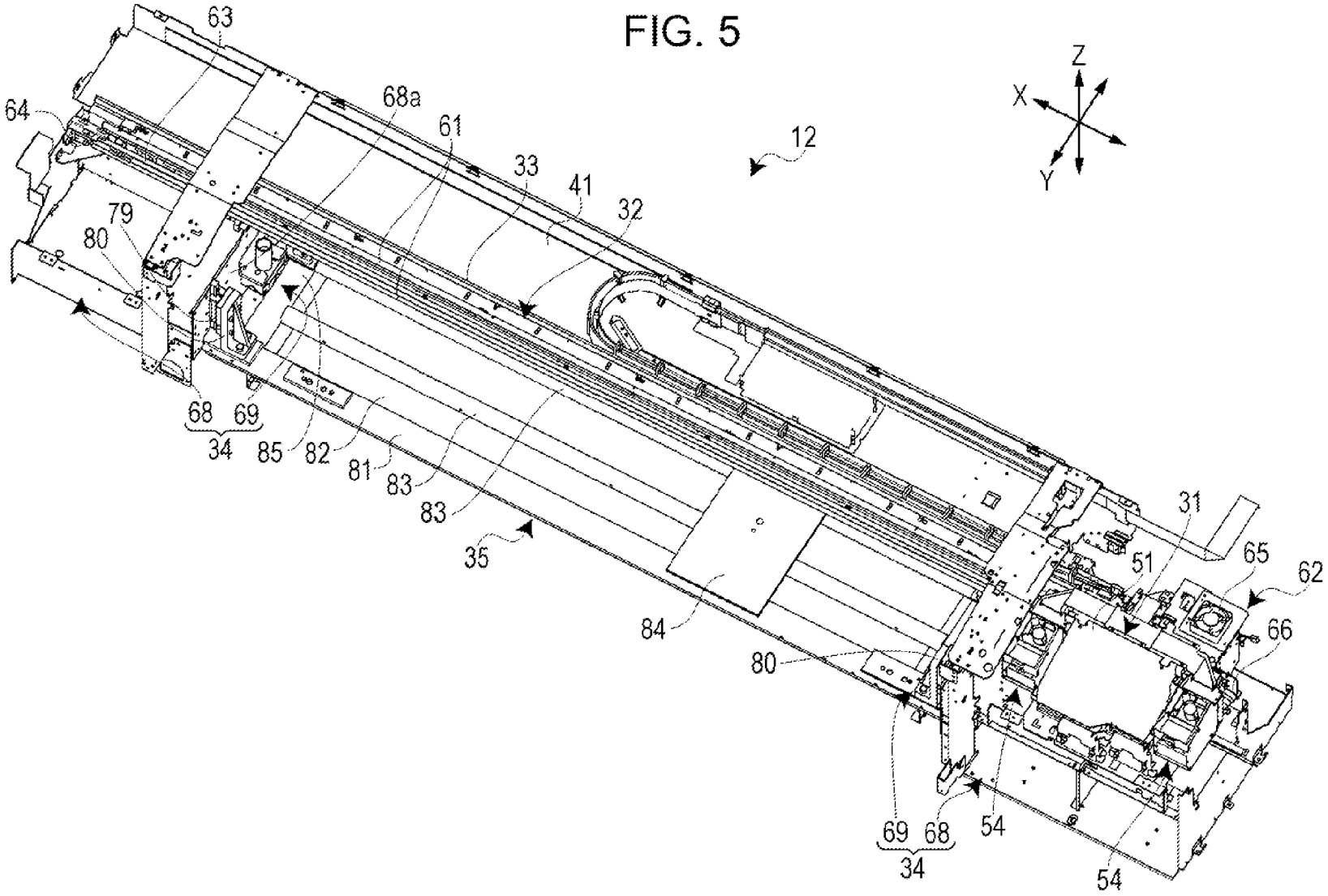
FIG. 5 is a perspective view showing a recording processing unit with the apparatus cover omitted.
Figure 6:
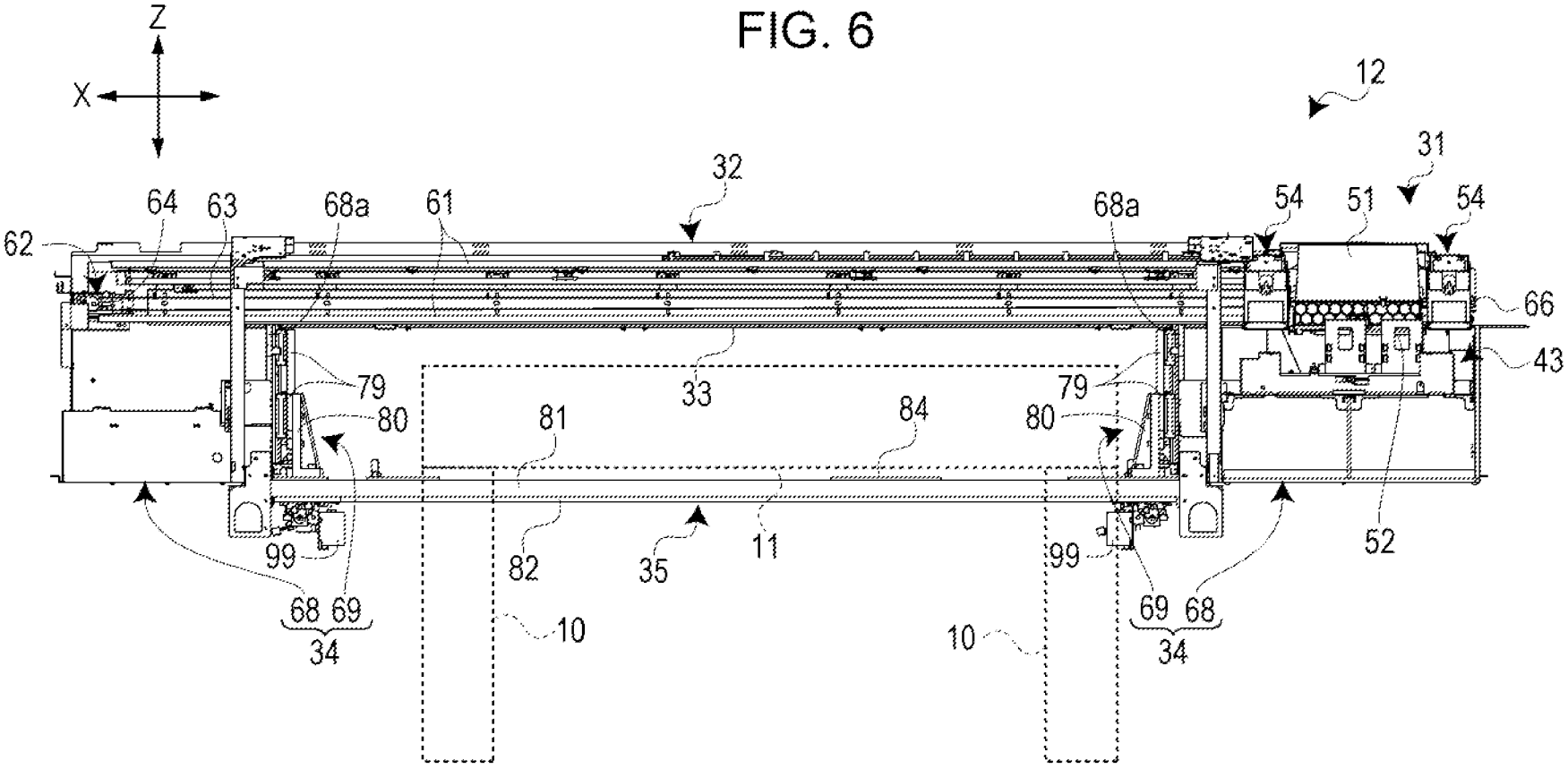
FIG. 6 is a front view showing the recording processing unit with the apparatus cover omitted.

As shown in FIGS. 5 and 6, the recording processing unit 12 is provided with a recording unit 31, an X axis movement unit 32, a horizontal bridging frame 33, a pair of left and right side frames 34, a connecting frame 35, and an apparatus cover (refer to FIG. 2) 36 that covers the above components. The recording unit 31 faces (i.e., opposes) the supported recording medium A and performs recording on the recording medium A. The X axis movement unit 32 supports the recording unit 31 and causes the recording unit 31 to move in the X axis direction. The horizontal bridging frame 33 supports the X axis movement unit 32. The side frames 34 support the horizontal bridging frame 33 from both sides in the X axis direction (the first side and the second side in the X axis direction). The connecting frame 35 connects the base portion sides of the pair of side frames 34 to one another. The horizontal bridging frame 33 extends in the X axis direction to cross over the supporting stage 11. Each of the side frames 34 extend downward to below the supporting stage 11, and the connecting frame 35 is connected to the lower end portions of both the side frames 34 further below the supporting stage 11 than the table main body 26.

The supporting stage 11 is bridged by the horizontal bridging frame 33, the pair of side frames 34 and the connecting frame 35; thus configuring a square-shaped (a rectangular-shaped) frame portion that surrounds the supporting stage 11.

The recording processing unit 12 includes a tube holding portion 41, a tank unit (refer to FIG. 1) 42, and a maintenance unit 43. The tube holding portion 41 is disposed on the rear side (the first side) of the horizontal bridging frame 33 in the Y axis direction and holds ink tubes, cables and the like, the tank unit 42 is disposed on the front right and includes ink tanks of various colors, and the maintenance unit 43 is provided in order to maintain and recover the functions of recording heads 52.

The recording unit 31 includes a carriage 51, on which two of the recording heads 52 are mounted, and a pair of ultraviolet radiation units 54, which are provided on both sides of the carriage 51 in the X axis direction. Each of the ultraviolet radiation units 54 includes an ultraviolet radiation LED from which ultraviolet rays are irradiated, which causes the ultraviolet curing ink that is discharged from the recording head 52 to cure (i.e., to be fixed).

The recording head 52 is an ink jet head that is driven to discharge by piezoelectric elements (piezo elements), and includes a plurality of nozzle rows (not shown) for each color that extend in the Y axis direction. In other words, the recording head 52 is configured to be capable of discharging plural colors of ultraviolet curing ink. Furthermore, the nozzle surface of the recording head 52 faces the recording medium A. Note that in this embodiment, a piezo system ink jet head is used. However, the invention it not limited thereto. For example, a thermal system or an electrostatic system ink jet head may also be used. The invention is also not limited to such on-demand types of ink jet heads, and a continuous type of ink jet head may also be used.

The X axis movement unit 32 is provided with a pair of upper and lower guide shafts 61, and an X axis drive mechanism 62. The guide shafts 61 are supported by the horizontal bridging frame 33 and support the recording unit 31 to reciprocally move freely along the X axis. The X axis drive mechanism 62 drives the recording unit 31 along the pair of guide shafts 61.

The X axis drive mechanism 62 is provided with a timing belt 63, a drive pulley 66 and a driven pulley 64, a connecting fixing portion (not shown), and a carriage motor 65. The timing belt 63 extends in the X axis direction along the pair of guide shafts 61, and bridges the drive pulley 66 and the driven pulley 64. The connecting fixing portion connects the timing belt 63 with the recording unit 31. The carriage motor 65 drives the drive pulley 66. In the X axis movement unit 32, by causing the carriage motor 65 to rotate forward and backward, the recording unit 31 is caused to move reciprocally in the X axis direction on the pair of guide shafts 61 via the timing belt 63. The recording process is performed by driving each of the recording heads 52 to discharge together with the reciprocal motion.

Figure 7:
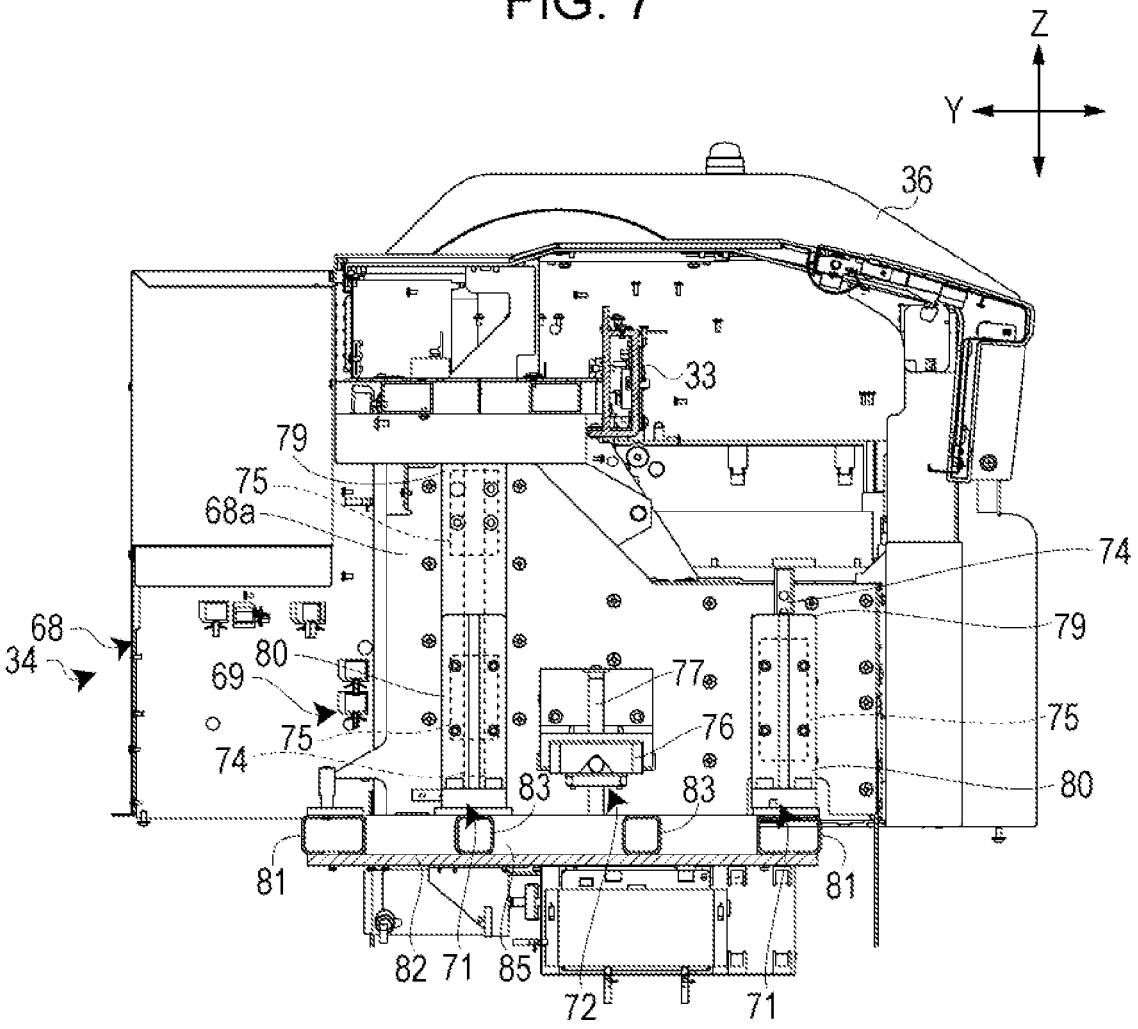
FIG. 7 is an inner side view showing a side frame and the periphery of a raising and lowering movement unit that is retrofitted therein.

Next, description will be given of the side frames 34 with reference to FIGS. 5 to 7. As shown in FIGS. 5 to 7, on each of the side frames 34, there is provided a raising and lowering movement unit 69 that causes the recording unit 31 to move in the vertical direction (the Z axis direction: a third direction), and causes the recording unit 31 to approach towards and separate from the supporting stage 11. Specifically, each of the side frames 34 is provided with a box-shaped frame main body 68 that supports the horizontal bridging frame 33, and a raising and lowering movement unit 69 that connects the frame main body 68 and the connecting frame 35 to one another. The raising and lowering movement unit 69 causes the frame main body 68 to move by being raised or lowered. By using the raising and lowering movement unit 69 to raise and lower the frame main body 68, the recording unit 31 is moved by being raised and lowered via the frame main bodies 68, the horizontal bridging frame 33, and the X axis movement unit 32. Accordingly, the recording unit 31 is caused to approach towards and separate from (i.e., adjust the gap with) the supporting stage 11 and the recording medium A that is supported by the supporting stage 11.

The frame main bodies 68 support the horizontal bridging frame 33. Furthermore, the frame main bodies 68 include fixing plate portions 68*a* (which fix the movable sides of each of the raising and lowering movement units 69) on the center side (i.e., the supporting stage 11 side) of the recording apparatus 1.

Each of the raising and lowering movement units 69 is provided with two raising and lowering guide mechanisms 71, a raising and lowering drive mechanism 72, and a raising and lowering drive motor 99. The raising and lowering guide mechanisms 71 support the frame main body 68 to be raised and lowered freely in relation to the connecting frame 35. The raising and lowering drive mechanism 72 is disposed between the two raising and lowering guide mechanisms 71 and causes the frame main body 68 to move in the vertical direction. The raising and lowering drive motor 99 drives the raising and lowering drive mechanism 72.

The raising and lowering guide mechanism 71 is configured by the LM GUIDE mechanism, which is formed from a raising and lowering guide rail 74 that is fixed to the fixing plate portions 68*a*. The raising and lowering guide mechanism 71 is also a raising and lowering slider 75 that is fixed to the connecting frame 35. Note that the symbols 79 and 80 are a first connecting member and a second connecting member, which connect the raising and lowering slider 75 and the connecting frame 35 to one another.

The raising and lowering drive mechanism 72 is provided with a ball screw mechanism that includes a raising and lowering nut member 76 that is fixed to the fixing plate portion 68*a*, and a raising and lowering threaded shaft 77 that is fixed to the connecting frame 35. Note that in this embodiment, a configuration is adopted in which the raising and lowering nut member 76 is fixed, the raising and lowering threaded shaft 77 is caused to move rotationally, and the raising and lowering nut member 76 is caused to move in the vertical direction relative to the raising and lowering guide rail 74. However, a configuration may also be adopted in which the raising and lowering threaded shaft 77 is fixed, the raising and lowering nut member 76 is caused to move rotationally, and the raising and lowering nut member 76 is caused to move in the vertical direction relative to the raising and lowering guide rail 74.

As shown in FIGS. 4 to 6, the connecting frame 35 is disposed on the rear surface side of the supporting stage 11. The connecting frame 35 is disposed to overlap (in the X and Y directions) a movement region of the recording unit 31 and a placement region of the recording medium A. Specifically, the connecting frame 35 is provided with a plurality of rod-shaped frames 81, a plate-shaped frame 82, a plurality of vertical frames 85, a plurality of horizontal frames 83, and an attachment plate 84. The rod-shaped frames 81 bridge the space between the base portion sides of both of the side frames 34. The lower surface side of the plate-shaped frame 82 is fixed to a plurality of the rod-shaped frames 81. The vertical frames 85 connect the plurality of rod-shaped frames 81 by both end portions thereof in the X axis direction. The horizontal frames 83 are fixed on the plurality of vertical frames 85 between the plurality of rod-shaped frames 81, and extend parallel to the rod-shaped frames 81. The attachment plate 84 bridges the plurality of rod-shaped frames 81, and a drive motor 88 (described hereinafter) of the Y axis movement unit 13 is attached thereto.

The Y axis movement unit 13 is provided with a pair of linear guide mechanisms 86, a Y axis movement mechanism (a lead screw mechanism) 87, the drive motor 88, and a pair of rail attachment bases 25*a* and 25*b*. The linear guide mechanisms 86 are positioned on both sides on the left and right of the rear surface side of the supporting stage 11, and cause the recording processing unit 12 to slide in the Y axis direction in relation to the supporting stage 11. The Y axis movement mechanism 87 is positioned on the center of the rear surface side of the supporting stage 11, and causes the recording processing unit 12 to move in the Y axis direction in relation to the supporting stage 11. The drive motor 88 drives the Y axis movement mechanism 87. The rail attachment bases 25*a* and 25*b* are fixed to the rear surface side of the supporting stage 11, and the guide rails 91 of each of the linear guide mechanisms 86 are attached thereto. The pair of linear guide mechanisms 86 are disposed to be separated from one another in the X axis direction, and the Y axis movement mechanism 87 is disposed between the pair of linear guide mechanisms 86 in the X axis direction. The drive mechanism referred to in an aspect of the invention is configured by the Y axis movement mechanism 87 and the drive motor 88.

The linear guide mechanisms 86 are configured by the LM guide mechanism. The linear guide mechanisms 86 include the guide rails 91, which are fixed to each of the rail attachment bases 25*a* and 25*b*, and extend in the Y axis direction, and sliders 92, which are fixed to the plate-shaped frame 82 of the connecting frame 35 and freely slide on the guide rails 91. The pair of guide rails 91 of the pair of linear guide mechanisms 86 include a guide rail 91*a* of the reference side (which is used as a reference during attachment), and a guide rail 91*b* of a corresponding following side. The guide rail 91*a* of the reference side is attached to the side at which the distributed load of the recording processing unit 12 is greater, that is, the right side (the left side in FIG. 4) where the tank unit 42 is present. On the other hand, the guide rail 91*b* of the following side is attached to the left side (the right side in FIG. 4).

The pair of rail attachment bases 25*a* and 25*b* includes the first rail attachment base 25*a* and the second rail attachment base 25*b*. The first rail attachment base 25*a* of the right side is fixed to the structural bar 21 of the right side (the left side in FIG. 4), and the guide rail 91*a* of the reference side is attached thereto. Meanwhile, the second rail attachment base 25*b* of the left side is fixed to the structural bar 21 of the left side of the recording apparatus 1 (the right side in FIG. 4), and the guide rail 91*b* of the following side is attached thereto. In this manner, the pair of rail attachment bases 25*a* and 25*b* are attached to be separated from one another in the X axis direction. The second rail attachment base 25*b* includes an attachment surface portion 93 that includes a rail attachment surface 93*a* onto which the guide rail 91*b* of the following side is attached.

On the other hand, the first rail attachment base 25*a* is provided with the attachment surface portion 93, which includes the rail attachment surface 93*a* to which the guide rail 91*a* of the reference side is attached, and an attachment reference portion 94. The attachment reference portion 94 continues in the X axis direction from the attachment surface portion 93, and has a thickness that protrudes downward from the rail attachment surface 93*a*. The first rail attachment base 25*a* is configured such that, in the X axis direction, the attachment surface portion 93 is fixed to the outside of the supporting stage 11, and the attachment reference portion 94 is fixed to the inside of the supporting stage 11. Accordingly, the attachment surface portion 93 (the rail attachment surface 93*a*) of the first rail attachment base 25*a* is disposed at a position in the X axis direction that is separated further from the Y axis movement mechanism 87 than the attachment reference portion 94. Since the first rail attachment base 25*a* is disposed on the right side (at which the distributed load of the recording processing unit 12 is greater), the load that the first rail attachment base 25*a* receives from the recording processing unit 12 is greater than that received by the second rail attachment base 25*b*.

An attachment reference surface 94*a* (which is the side surface attachment reference of the guide rail 91*a* of the reference side) is formed on the side surface of the rail attachment surface 93*a* side of the attachment reference portion 94. Furthermore, the attachment reference portion 94 reinforces the rigidity of the structural bar 21 due to the thickness and the width of the attachment reference portion 94. In other words, the structural bar 21 of the right side (where the distributed load of the recording processing unit 12 is greater), is reinforced. Due to this reinforcement, the configuration is such that the amount of deflection, caused by the distributed load of the recording processing unit 12, of the pair of structural bars 21 is the same. Accordingly, the amount of deflection, caused by the load from the recording processing unit 12, of the supporting stage 11 is the same between the first rail attachment base 25*a* side and the second rail attachment base 25*b* side.

The Y axis movement mechanism 87 is mounted on the connecting frame 35, and is configured by a ball screw mechanism. The Y axis movement mechanism 87 includes a threaded shaft 96, which is fixed to the supporting stage 11 and extends in the Y axis direction, and a nut member 98, which is fixed to the plate-shaped frame 82 of the connecting frame 35 via a supporting member 97 to rotate freely and screws onto the threaded shaft 96. The (axis center of the) Y axis movement mechanism 87 is disposed between the surface (supporting surface: the portion that makes contact with the recording medium A) of the supporting stage 11 and the linear guide mechanisms 86 in the vertical direction (the direction in which the recording unit 31 and the supporting stage 11 oppose one another). The nut member 98 is caused to move in the Y axis direction relative to the threaded shaft 96 along a thread groove that is formed in the threaded shaft 96 by using the drive motor 88 to drive (e.g., rotate) the nut member 98. In this manner, the recording processing unit 12 is caused to move in the Y axis direction along the linear guide mechanisms 86 using the Y axis movement unit 13. In other words, the Y axis movement unit 13 causes the recording unit 31 to move in the Y axis direction via the frame portion (the horizontal bridging frame 33, the side frame 34, and the connecting frame 35). Note that, in this embodiment, a configuration is adopted in which the threaded shaft 96 is fixed and the nut member 98 is driven to rotate. However, a configuration may also be adopted in which the nut member 98 is fixed and the threaded shaft 96 is driven to rotate. By extension, a configuration may also be adopted in which the nut member 98 is caused to move in the Y axis direction relative to the threaded shaft 96 by rotationally driving both the nut member 98 and the threaded shaft 96.

In this embodiment, the rotating side and the fixed side of the raising and lowering drive mechanism 72 and the Y axis movement mechanism 87 are the reverse of one another with respect to the nut member (the raising and lowering nut member 76 and the nut member 98) and the threaded shaft (the raising and lowering threaded shaft 77 and the threaded shaft 96). However, these may also be the same. In other words, there is conceived to be a pattern in which the raising and the lowering threaded shaft 77 and the nut member 98 are the rotating side, and the raising and the lowering nut member 76 and the threaded shaft 96 are the fixed side (this embodiment). There is also conceived to be a pattern in which the raising and the lowering nut member 76 and the threaded shaft 96 are the rotating side, and the raising and lowering threaded shaft 77 and the nut member 98 are the fixed side. Furthermore, there may be a pattern in which the raising and lowering threaded shaft 77 and the threaded shaft 96 are the rotating side, and the raising and the lowering nut member 76 and the nut member 98 are the fixed side. Also, there may be a pattern in which the raising and lowering nut member 76 and the nut member 98 are the rotating side, and the raising and lowering threaded shaft 77 and the threaded shaft 96 are the fixed side.

In the recording operation of the recording apparatus 1, the recording unit 31 is caused to be raised or lowered to a predetermined gap position in relation to the recording surface of the recording medium A by the raising and lowering movement units 69. Subsequently, the recording processing unit 12 is caused to move intermittently from the second side to the first side in the Y axis direction by the Y axis movement unit 13 (line feed). During each pause in the intermittent movement of the recording processing unit 12 in the Y axis direction, the recording unit 31 is caused to move in the X axis direction using the X axis movement unit 32, and the ink is caused to be discharged from the recording head 52 (recording process). Accordingly, a desired image is recorded on the recording medium A.

Note that, in this embodiment, when recording execution is commanded using the operation panel unit 24, a test operation is executed before the recording operation. In other words, the user places the recording medium A on the supporting stage 11 in a state in which the recording processing unit 12 is disposed on the first side in the Y axis direction (the waiting position side when setting the recording medium A). Next, the user commands the recording execution using the operation panel unit 24 in a state in which the recording medium A is placed on (held by) the supporting stage 11. When the printing execution is commanded, the recording apparatus 1 causes the recording processing unit 12 to move to the second side in the Y axis direction (the operation panel unit 24 side) using the Y axis movement unit 13. At this time, while the recording unit 31 moves from the first side in the Y axis direction to the second side in the Y axis direction, contact between the recording processing unit 12 and an obstacle (regardless of whether the obstacle is one that the recording unit 31 is likely to make contact with) is detected using an obstacle detection sensor (not shown) that is provided in the recording processing unit 12. Accordingly, the test operation is executed. The obstacle detection sensor detects whether there is a likelihood that the recording medium A and the recording unit 31 will come into contact with one another, and whether an obstacle that the recording unit 31 is likely to make contact with is present on the recording medium A or on the supporting stage 11.

When an obstacle is detected in this test operation, the recording apparatus 1 causes the movement of the recording processing unit 12 to the second side in the Y axis direction to stop, and notifies the user of the error. On the other hand, when an obstacle is not detected while causing the recording processing unit 12 to move from the first side in the Y axis direction to the second side in the Y axis direction, the recording apparatus 1 determines that there are no obstacles, causes the recording processing unit 12 to move to a predetermined position on the second side in the Y axis direction (the recording start position side) and temporarily stops the movement. After temporarily stopping the movement, the recording apparatus 1 causes the recording processing unit 12 to move from the second side in the Y axis direction (the recording start position side) to the first side in the Y axis direction, and starts the recording operation.

According to the configuration described above, by disposing the linear guide mechanisms 86 on the rear surface side of the supporting stage 11, the position of the recording processing unit 12 is not heightened by the amount of the dimensions of the linear guide mechanisms 86. In other words, it is possible to reduce the height dimension of the entire recording apparatus 1 (the dimension of the direction in which the recording unit 31 and the supporting stage 11 oppose one another). By causing the supporting stage 11 and the linear guide mechanism 86 to overlap one another by disposing the linear guide mechanisms 86 on the rear surface side of the supporting stage 11, it is possible to reduce the planar dimensions (the dimensions of the directions that are perpendicular to the opposing direction described above) of the entire recording apparatus 1 in comparison with a configuration in which the linear guide mechanism 86 is disposed on the lateral side of the supporting stage 11. Furthermore, the linear guide mechanisms 86 do not interfere with the recording performed by the recording unit 31 due to the linear guide mechanisms 86 being disposed on the rear surface side of the supporting stage 11. Accordingly, it is possible to dispose the linear guide mechanism 86 to overlap with the movement region of the recording unit 31 and the placement region of the recording medium A in the X and Y directions. Thus, it is possible to reduce the planar dimensions of the entire recording apparatus 1 even in comparison to a configuration in which the linear guide mechanisms 86 are disposed on the upper surface side of the supporting stage 11. In addition, it is possible to guarantee the parallelism of the table attachment surfaces onto which the table main body 26 is attached, and the parallelism of the rail attachment surfaces 93*a* onto which the guide rails 91 are attached by only milling the upper and lower surfaces thereof in relation to the structural bars 21 to which the rail attachment bases 25*a* and 25*b* are fixed. Accordingly, it is possible to manufacture the recording apparatus 1 easily in comparison to a configuration in which "the linear guide mechanisms 86 are disposed on the lateral sides of the supporting stage 11", where it is necessary to mill the side surfaces.

By using a plurality of the linear guide mechanisms 86 that are separated from one another in the X axis direction, it is possible to stably perform the movement of the recording unit 31 in the X axis direction regardless of the position of the Y axis movement mechanism 87.

By using two of the linear guide mechanisms 86, which are disposed to interpose the Y axis movement mechanism 87. It is also possible to stably perform the movement of the recording unit 31 in the Y axis direction.

In addition, the Y axis movement mechanism 87 is disposed between a portion (the surface) of the supporting stage 11 that makes contact with the recording medium A and the linear guide mechanism 86 in the direction in which the recording unit 31 and the supporting stage 11 oppose one another. Thus, it is possible to dispose the Y axis movement mechanism 87 as close as possible to the portion of the supporting stage 11 that makes contact with the recording medium A. Therefore, it is possible to suppress the influence of pitching centered on the Y axis movement mechanism 87. The Y axis movement mechanism 87 does not interfere with the recording performed by the recording unit 31 due to the Y axis movement mechanism 87 being disposed between the portion of the supporting stage 11 that makes contact with the recording medium A and the linear guide mechanisms 86. Accordingly, it is possible to dispose the Y axis movement mechanism 87 and the drive motor 88 to overlap with the movement region of the recording unit 31 and the placement region of the recording medium A in the X and Y directions.

It is possible to accurately perform the movement of the recording unit 31 relative to the supporting stage 11 due to the fixed side (the guide rail 91) of the linear guide mechanism 86 being fixed to the supporting stage 11, and the movable side (the slider 92) of the linear guide mechanism 86 being fixed to the connecting frame 35. Accordingly, it is possible to improve the movement accuracy of the recording unit 31.

Due to mounting the Y axis movement mechanism 87 on the connecting frame 35, the linear movement carried out by the Y axis movement mechanism 87 is not shifted in the X axis direction, and it is possible to more stably perform the movement of the recording unit 31 in the Y axis direction. The configuration described above does not impede the attachability or maintainability of the Y axis movement mechanism 87.

Note that, in this embodiment, a configuration is adopted in which two of the linear guide mechanisms 86 are provided; however, a configuration may also be adopted in which only one of the linear guide mechanisms 86 is provided, and a configuration may also be adopted in which three or more of the linear guide mechanisms 86 are provided to be separated from one another in the X axis direction.

In this embodiment, a configuration was adopted in which one of the Y axis movement mechanisms 87 is provided; however, a configuration may also be adopted in which a plurality of the Y axis movement mechanisms 87 are provided to be separated from one another in the X axis direction.

Furthermore, in this embodiment, a configuration is adopted in which the linear guide mechanisms 86 and the Y axis movement mechanism 87 are disposed, together, on the rear surface side of the supporting stage 11; however, a configuration may also be adopted in which only one of these is disposed on the rear surface side of the supporting stage 11, and the other is disposed on the lateral side or the surface side of the supporting stage 11.

In this embodiment, an LM guide mechanism (a linear ball guide mechanism) is used as the linear guide mechanism 86; however, a sliding guide mechanism, or the like, for example, may also be used as the linear guide mechanism 86.

In this embodiment, a ball screw mechanism is used as the Y axis movement mechanism 87; however, the invention is not limited thereto. In other words, a sliding screw mechanism, a belt mechanism, or the like may also be used as the Y axis movement mechanism 87.

In this embodiment, the invention is applied to the recording apparatus 1 in which recording is performed by moving the recording unit 31 in the X and Y directions; however, a configuration may also be adopted in which the invention is applied to the recording apparatus 1 in which recording is performed by moving the recording unit 31 that includes a line head in only the Y axis direction (a so-called line printer).

Note that, in this embodiment, the X axis direction is the so-called main scanning direction, and the Y axis direction is the so-called sub-scanning direction.

The entire disclosure of Japanese Patent Application No: 2013-065767, filed Mar. 27, 2013 is expressly incorporated by reference herein in its entirety.

What is claimed is:

1. A recording apparatus, comprising:

a stage, which includes a supporting surface that supports a recording medium;

a recording processing unit, which includes a recording unit that performs recording on the recording medium that is supported by the stage, and bridges a first direction so as to cross the stage; and a movement unit, which causes the recording processing unit to move in relation to the stage in a second direction that is perpendicular to the first direction and is parallel to the supporting surface, wherein the movement unit includes:

a drive mechanism, which causes the recording processing unit to move in the second direction in relation to the stage, and a linear guide mechanism, which is disposed on a rear surface side of the stage, and supports the recording processing unit to be free sliding in the second direction in relation to the stage, wherein the drive mechanism is disposed between a portion of the stage that makes contact with the recording medium, and the linear guide mechanism in a third direction, which is perpendicular to the first direction and the second direction.

2. The recording apparatus according to claim 1, wherein the movement unit includes a plurality of the linear guide mechanisms, which are separated from one another in the first direction.

3. The recording apparatus according to claim 2, wherein the drive mechanism is disposed between the plurality of linear guide mechanisms in the first direction.

4. The recording apparatus according to claim 1, wherein the recording processing unit includes a recording unit, a horizontal bridging frame, which crosses the stage and supports the recording unit, a pair of side frames, which holds the horizontal bridging frame by a first side and a second side in the first direction, and a connecting frame, which connects base portion sides of the pair of side frames to one another, and wherein the linear guide mechanism includes a guide rail, which is fixed to a rear surface side of the stage, and extends in the second direction, and a slider, which is fixed on the connecting frame, and moves on the guide rail in a free sliding manner.

5. The recording apparatus according to claim 4, wherein the drive mechanism is mounted on the connecting frame.

6. The recording apparatus according to claim 1, wherein the drive mechanism is configured by a drive motor, and a lead screw mechanism, which is driven by the drive motor.

7. A recording apparatus, comprising:

a stage, which includes a supporting surface that is configured to support a recording medium;

a recording processing unit, which includes a recording unit that is configured to perform recording on the recording medium in at least some instances when the recording medium is supported by the stage, the recording processing unit bridges crossing the stage in a first direction; and a movement unit, which causes the recording processing unit to move in relation to the stage in a second direction that is perpendicular to the first direction and is parallel to the supporting surface, wherein the movement unit includes:

a drive mechanism, which causes the recording processing unit to move in the second direction in relation to the stage, and a linear guide mechanism, which is disposed on a rear surface side of the stage, and supports the recording processing unit to be free sliding in the second direction in relation to the stage, wherein the drive mechanism is disposed between a portion of the stage that makes contact with the recording medium, and the linear guide mechanism in a third direction, which is perpendicular to the first direction and the second direction.

8. A recording apparatus, comprising:

a stage, which includes a supporting surface that supports a recording medium;

a recording processing unit, which includes a recording unit that performs recording on the recording medium that is supported by the stage, and bridges a first direction so as to cross the stage; and a movement unit, which causes the recording processing unit to move in relation to the stage in a second direction that is perpendicular to the first direction and is parallel to the supporting surface, wherein the movement unit includes:

a drive mechanism, which causes the recording processing unit to move in the second direction in relation to the stage, and a plurality of linear guide mechanisms, which are disposed on a rear surface side of the stage, support the recording processing unit to be free sliding in the second direction in relation to the stage, and are separated from one another in the first direction, wherein the drive mechanism is disposed between the plurality of linear guide mechanisms in the first direction.

* * * * *